US005170148A

United States Patent [19]

Duggan et al.

[11] Patent Number: 5,170,148

[45] Date of Patent: Dec. 8, 1992

[54] RADIANT ENERGY TESTING DEVICE FOR FIRE DETECTORS

[75] Inventors: Jack Duggan, 167 Old Sheppard Ave., Willowdale, Ontario, Canada, M2J 3M2; Robert Matthews, Downsview, Canada

[73] Assignee: Jack Duggan, Markham, Canada

[21] Appl. No.: 532,579

[22] Filed: Jun. 4, 1990

[51] Int. Cl.[5] ..... G08B 29/00

[52] U.S. Cl. ..... 340/515; 340/514; 340/693; 219/240

[58] Field of Search ..... 340/515, 514, 584, 586, 340/588, 589, 658, 640, 578, 591, 628, 629, 693; 219/221, 227, 228, 240, 229

[56] References Cited

U.S. PATENT DOCUMENTS

| | | | |
|---|---|---|---|
| 2,063,703 | 12/1936 | Siddall | 340/515 |
| 2,493,351 | 1/1950 | Jones | 340/515 |
| 2,785,267 | 3/1957 | Wickersham | 219/228 |
| 3,693,401 | 9/1972 | Purt et al. | 340/515 |
| 4,651,140 | 3/1987 | Duggan | 340/589 |
| 4,864,146 | 9/1989 | Hodges et al. | 340/515 |

FOREIGN PATENT DOCUMENTS

| | | | |
|---|---|---|---|
| 3013599 | 12/1980 | Fed. Rep. of Germany | 340/693 |

*Primary Examiner*—Edward L. Coles, Sr.
*Assistant Examiner*—Jill Jackson

[57] ABSTRACT

A testing device for fire detectors comprises a resistance heating coil disposed outwardly of a clear central area and a collar located to one side of and about the resistance heating element for locating of a fire detector relative to the heating element. The heating element is of a low thermal mass and is quickly activated when connected to a power source thereby radiating heat directly to the housing of the detector. The collar is sized to position the resistance heating coil immediately adjacent the surface of the fire detector and spaced from the heat collection fin to thereby cause a rate of temperature rise within the pressure chamber of the fire detector while maintaining the heat collection fin below its activation point.

21 Claims, 4 Drawing Sheets

FIG. 2.
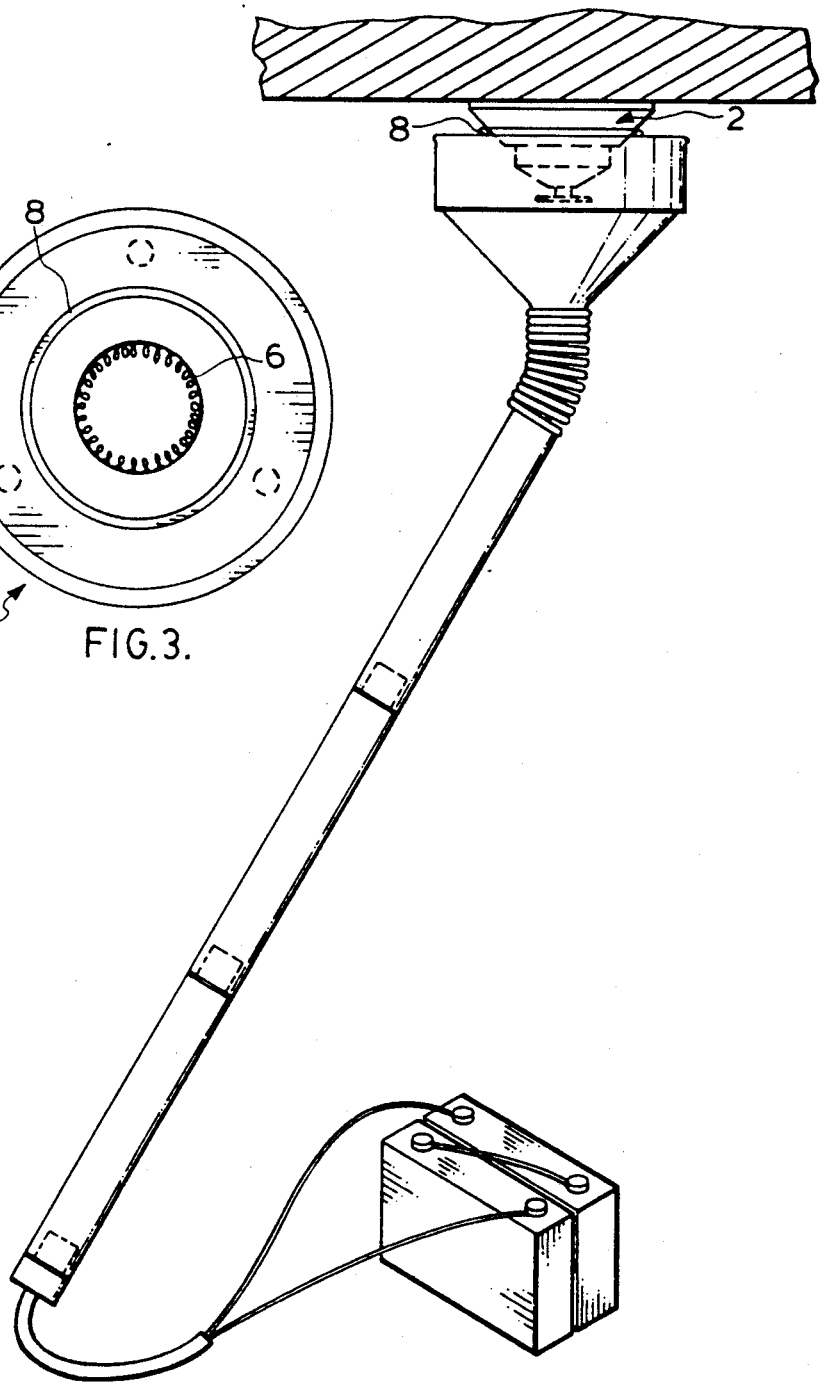
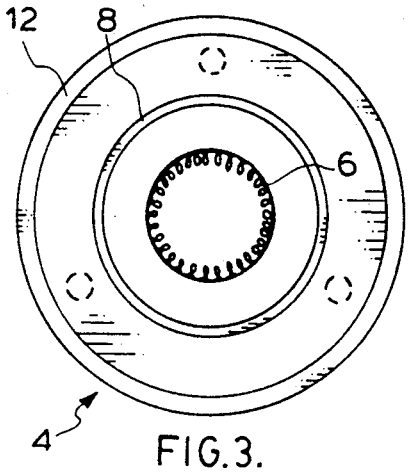
FIG. 3.

RADIANT ENERGY TESTING DEVICE FOR FIRE DETECTORS

BACKGROUND OF THE INVENTION

The present invention relates to testing devices for fire detectors where the fire detector has at least one mode of activating the alarm which is resettable without replacement of the fire detector. The invention also relates to the cooperation between the testing device and the fire detector for selective enèrgy transfer to the fire detector.

Fire detectors are well known and operate on several different modes. The simplest form of a fire detector is a fixed temperature fire detector which is designed to complete an electrical circuit once a certain temperature has been exceeded. In some cases the fire detector will be rated for a temperature of 135° F. or possibly 180° or 200° F., depending upon its particular application. In addition to fixed temperature point fire detectors, fire detectors can also have a structure for sensing the rate of temperature rise. In a fire situation, the air temperature within the building or structure, subject to combustion, rises quite rapidly and this rapid rise in temperature can be sensed. For example, often fire detectors will be rated for a rate of rise of 15° F. per minute. This is generally accomplished by having a variable volume pressure chamber with a control orifice which allows bleeding of the pressure such that the pressure in the pressure chamber is normally at atmospheric pressure. If for some reason the temperature of the room rapidly rises, the pressure within the pressure chamber will increase and force a diaphragm member to a distorted position where it closes an electrical circuit and completes the alarm. The control orifice is set or calibrated for a particular rate of rise. These rate of rise detectors are reusable in that if they sense a fire condition and activate the alarm, once the normal condition is returned or the rate of rise is no longer sufficient to hold the contacts together, the fire detector goes back to its normal position and will continue to operate and activate the alarm should a further rate of temperature rise be experienced. Such is not the case with some fixed point temperature sensing fire detectors where at a certain temperature a spring mechanism is released which closes the contacts and once so activated, the fire detector must be replaced.

Other fire detectors use a bi-metallic spring which moves at a given fixed point changing from concave to convex when sufficient heat is applied. Such fixed point detectors automatically reset when alloed to cool.

The testing of fire detectors having two activation mechanisms, one of which is reusable, has been accomplished in the past, however they generally rely on the heating of the air about the fire detector where the energy is transferred to the fire detector primarily by convection or convection in combination with radiation. These devices have not configured the heating source in a manner to concentrate or focus radiate energy on a particular surface of a fire detector and, in general, the entire unit has been equally heated by convection.

Prior art testing devices would include lighters used by technicians in the field, electrical light bulbs which heat the air and cooperate with a housing to provide a closed envelope of air about a fire detector with this envelope not only heating the collection fin of the fixed point temperature, but the housing of the fire detector which would have a pressure chamber therewithin. In some cases, the use of electric light bulbs, such as a 100 watt bulb, has been used and a glob of heat resistant material has been applied to the end of the bulb to isolate the surface temperature of the bulb at that point from the fin. The surface of the light bulb is very high and the normal configuration of the light bulb would be such to generally position this hot surface very close to the collection fin.

Hair dryers and hot water sponges have also been used to raise the temperature of a fire detector for testing purposes.

One can appreciate that it is important to periodically test a fire detecting system if possible and certainly this is possible where the activating mechanism is reusable once brought to the activation point. It can also be appreciated that care must be exercised to ensure, in fire detectors which have dual systems, one of which is not reusable, that the mechanism which is not reusable is not activated during the testing of the device.

The fire detectors basically rely on energy being transferred to the fire detector to heat the fire detector and, when appropriate, activate the same. The rate of rise actuation can operate at a much lower temperature in that it is looking for the rate of temperature change as determined by a change in pressure within the pressure chamber. In testing of a rate of rise fire detector, it is important to apply heat to the fire detector in a manner that the one time fixed temperature sensor does not become activated. It is desirable that the heat be monitored to allow the user to discontinue the test prior to reaching the activation point of the fixed temperature.

SUMMARY OF THE INVENTION

A testing device for fire detectors according to the present invention comprises a resistance heating coil disposed outwardly of a clear center area and stop means located to one side of and about the resistance heating element for locating of a fire detector relative to the heating element. The heating element is of a low thermal mass and reacts very quickly to a stoppage in the power supply whereby the heating element does not continue to significantly increase the temperature of the fire detecting device once the power has been discontinued. The detector has a variable volume pressure chamber partially defined by a housing of the detector and the testing device includes a heating resistance element configured to be in close proximity to the housing and radiate energy thereto with the surrounding air acting, during the normal operation, to remove heat from the housing.

The resistance element heater, preferably in the form of a coil heating element, has very low thermal mass, is quickly activated when connected to a power source, and can radiate heat directly to the housing. In contrast to prior art devices, energy is preferably transmitted to the housing remote the fixed point sensor by radiation. By spacing the heating element from the sensing element of the fixed temperature, the rate of radiation to that surface is greatly decreased. Thus, the radiation energy is concentrated in a particular location of the fire detector and is isolated at least to a large extent from the collection source of the fixed point temperature. A measure of control is provided as the surrounding air can act as a heat sink, thus further limiting energy transfer to the housing once the power has been cut. As the heating element preferably has low thermal mass, its response time is also short.

The concept of transmitting energy by radiation and not relying on convection heat transfer from the air to the heat detector, is more effective as it can be selectively applied to different surfaces of the fire detector. This is particularly beneficial with the fixed point non-reusable fire detectors which also have a reusable rate of rise detector. In other applications, particularly where the fixed point temperature is reusable, it may be desirable to initially test the rate of rise and then subsequently, after a passage of time, have the fixed point be activated. Therefore, although the fire detector testing device of the present invention uses the selective application of concentrated radiant energy to particular surfaces of the fire detector, it can also eventually operate on heating of the air between the detecting device and the fire detector, if desired.

BRIEF DESCRIPTION OF THE PREFERRED EMBODIMENTS

Preferred embodiments of the invention are shown in the drawings, wherein:

FIG. 2 is a side elevation of the fire detector and testing device in combination with the fire detector secured beneath the ceiling;

FIG. 3 is a top view of the fire detecting test device;

DETAILED DESCRIPTION OF THE PREFERRED EMBODIMENTS

Figure 1:
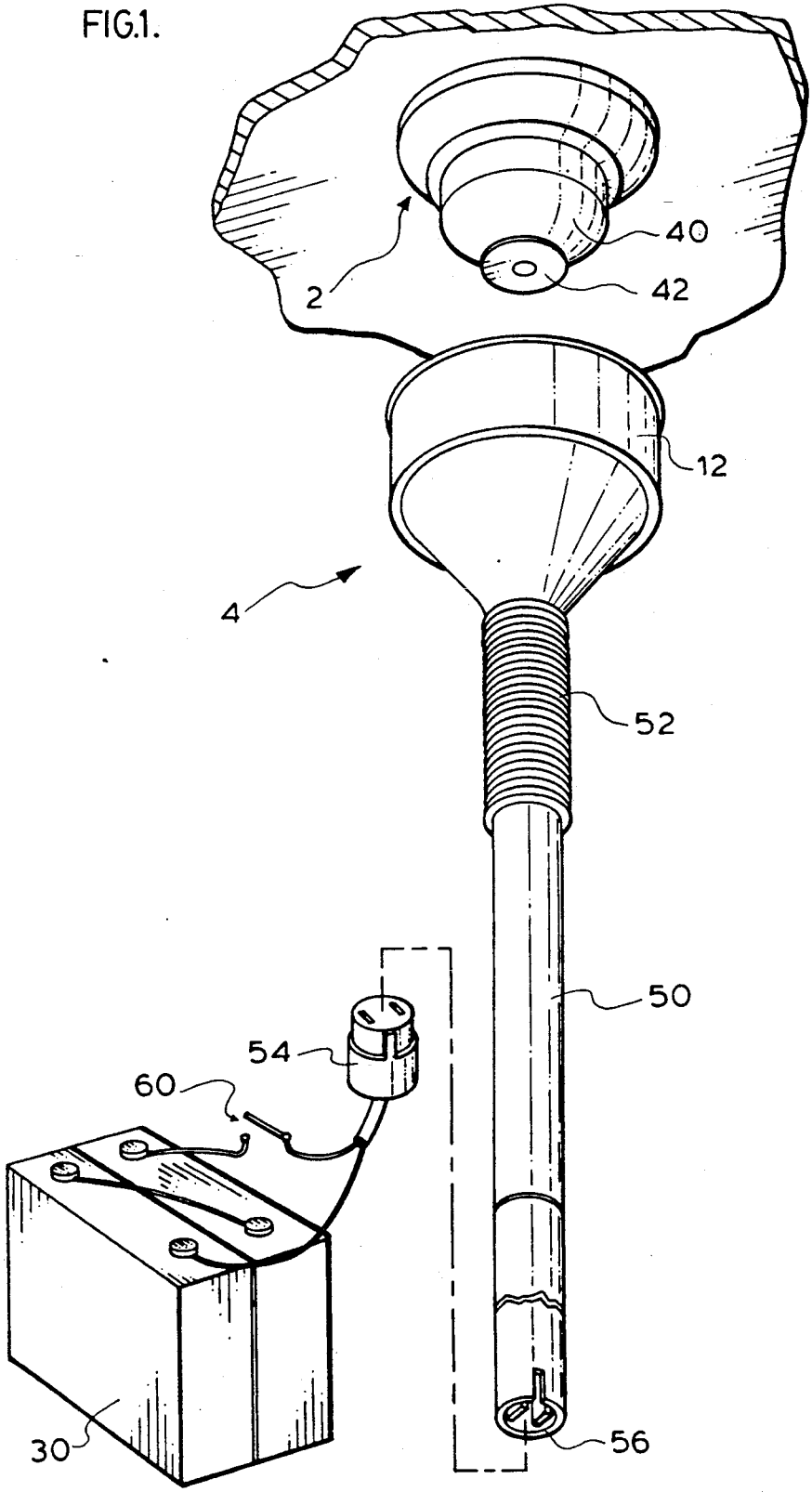
FIG. 1 is a partial perspective view of the device and power supply about to be applied to a fire detector secured beneath the ceiling.

The fire detector 2 as shown in FIGS. 1 and 2 is secured beneath the surface of a ceiling and the fire detector testing device generally shown as 4 is brought into alignment with the fire detector 2 in FIG. 2. The fire detecting testing device 4 includes, within the protective collar or housing 10, a locating collar 8 which cooperates with a resistance coil heater 6, having a particular pattern, in this case, because of the circular fin member 42 of the fire detector 2, the coil heater has a circular pattern with a clear central area. This arrangement of the testing device when placed in an operative position relative to the fire detector 2 spaces the coil heater 6 from the heat collecting fin 42 which passes through this central area. The details of this relationship will be discussed with respect to FIG. 5. The fire detector shown would include a variable volume pressure chamber therewithin indicated as 40, and this chamber 40 has a diaphragm which cooperates with leaf springs for activating or completing a circuit when a certain pressure within the chamber is reached. Fire detectors of this type are sold by Fire Detection Devices Limited, Edwards A Unit of General Signal and Chemetron Fire Systems with one such fire detector device of Fire Detection Devices Limited being generally shown in U.S. Pat. Nos. 3,271,547 and 3,827,012.

Use of the fire detector testing device can be appreciated from FIGS. 1 and 2 where the testing device 4 has a number of extension handles 50 allowing a user to locate the housing 12 about a fire detector 2 while the operator is at floor level. These extension handles 50 also serve to provide a power connection between the power source 30 and the resistance heating coil 6. For operator convenience, the power supply also has a on/-off switch generally indicated as 60. Each of the extension handles has a male connector 56 generally located within the handle and a female connector 54 at the opposite end for connection with a like handle. Secured beneath the outer housing 12 is a coil spring 52 which is a convenient approach for allowing manipulation of the outer housing whereby the orientation of the handle relative to the axis of the housing can be varied. This may be important depending upon the position of the fire detector 2 or positions of other obstacles beneath the fire detector 2.

The power supply 30 in this case is two 12 volt batteries wired in series to produce a 24 volt power supply. Such a power supply can be recharged and carried by the operator and is normally sufficient for a full day's operation without replacement. This is important as the spacing between fire detectors is anywhere from about 30 feet to approximately 70 feet and, in testing of these devices, operator mobility and an independent power supply reduces the testing time. Therefore, it is important that the power supply be portable, otherwise a great deal of time is lost in making an operative connection with a permanent source of power in the building.

As shown in FIG. 2 and FIG. 3, the locating collar 8 contacts the fire detector on its housing at a point spaced from the heat collection fin 42 and this collar ensures that the fire detector is not marked during the testing. It also acts to form somewhat of a seal and thus limit the flow of air escaping at that point. The collar 8 also serves to appropriately locate the resistance coil heater 6 relative to the fire detector 2 for the selective concentrated transmission of radiation energy to selected or desired areas of the fire detector. The exact shape of the fire detector 2 will vary from manufacturer to manufacturer and the collar may be modified for the testing of particular fire detectors.

Figure 5:
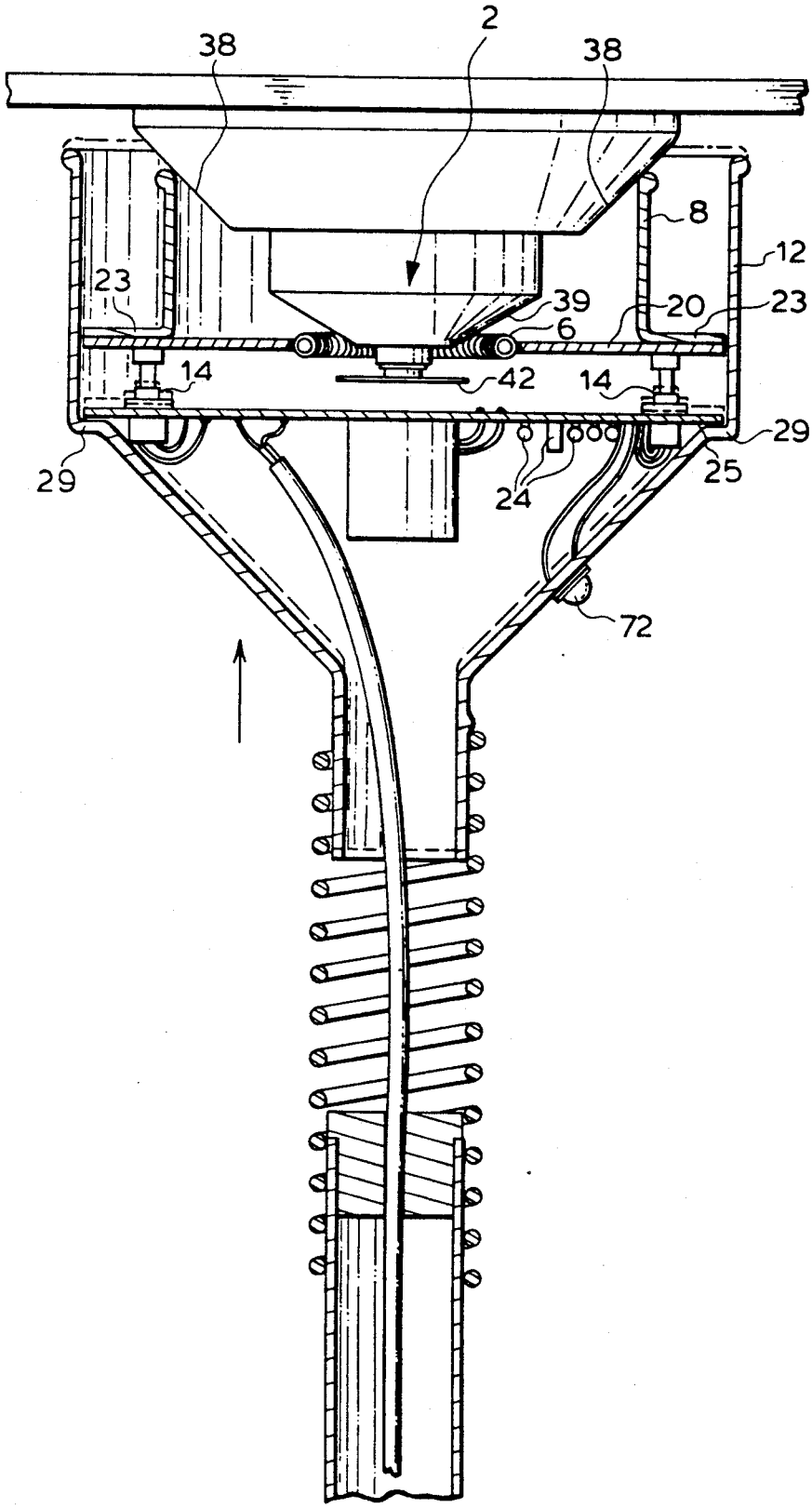
FIG. 5 is a sectional view through the fire detector testing device.

The appropriate operating position is shown in FIG. 5 where the locating collar 8 has come in contact with surface 38 which forms part of the collar around the heat detector 2. Collar 8 has been sized to position the resistance coil heater 6 immediately adjacent the surface 39 of the fire detector 2 and in a manner to be spaced from the heat collecting fin 42 a greater distance than the spacing between wall 39 and the resistance coil heater 6. In this way, the resistance coil heater 6 will transfer energy to the immediately adjacent portion of the wall 39 at a rate greater than the energy radiated to the heat collection fin 42. In this way, the pressure chamber located within the fire detector 2, and which wall 39 forms part of, will be heated to cause a rate of temperature rise sufficient to activate the fire detector while maintaining the heat collection fin 42 below its activation point. As mentioned before, the air within the housing of the testing device and adjacent fire detector 2 can act as a heat sink and maintain fin 42 well below the activation point. The primary mode of heat transfer is by radiation and the resistance coil heater 6 has been selected such that when the power is cut to the resistance coil heater 6, it will rapidly cool due to its low thermal mass and the cooler environment of the air. Should the testing device be left on for an extended period of time, the heating element would eventually heat the air within the testing device, however, this is not the primary purpose.

Movement of the collar 8 within the housing 12 is against the spring bias of electrical switches 14 with these switches being wired in parallel with the resistance coil heater 6 whereby the completion of any switch will operatively connect the resistance coil heater 6 to the power supply, given that switch 60 is closed. Also included with the circuit of the device is an audible alarm 22 which is activated after a predetermined period of time, preferably about 20 seconds. The particular period of time is sufficient to ensure that sufficient energy has been transmitted to the fire detector to cause the rate of rise sensor to be activated, but not sufficient to raise the temperature of the fixed point to its activation point. Thus, the audible alarm 22 will provide an audible warning that the testing device should be removed, otherwise there is a danger of activating the fixed point temperature mechanism. In addition, the circuit includes a light emitting diode 72 which provides a visual indication that the circuit is activated. The components of the timing circuit for audible alarm 22 are shown as 24. From the above, it can be appreciated that the testing device can be activated merely by pushing the collar 8 against the collar 38 of a fire detector thereby aligning the fire detector and closing one of the switches 14 with the resistance coil heater 6 properly positioned relative to the fire detector 2.

The mounting board 20 which secures the resistance coil heater 6, preferably has a number of solder pads generally shown as 15 spaced about the periphery of the resistance coil heater 6 which is located within the central aperture in the mounting board 20. The fine wire of the resistance coil heater can be somewhat difficult to secure and to simplify this, the solder pads 15 cooperate with separate short wire segments 17 which extend from the solder pad, loop about a portion of the resistance coil heater, and return to the solder pad. In this way, small loops of wire are secured to the solder pads 15 and locate the resistance coil heater 6.

Figure 4:
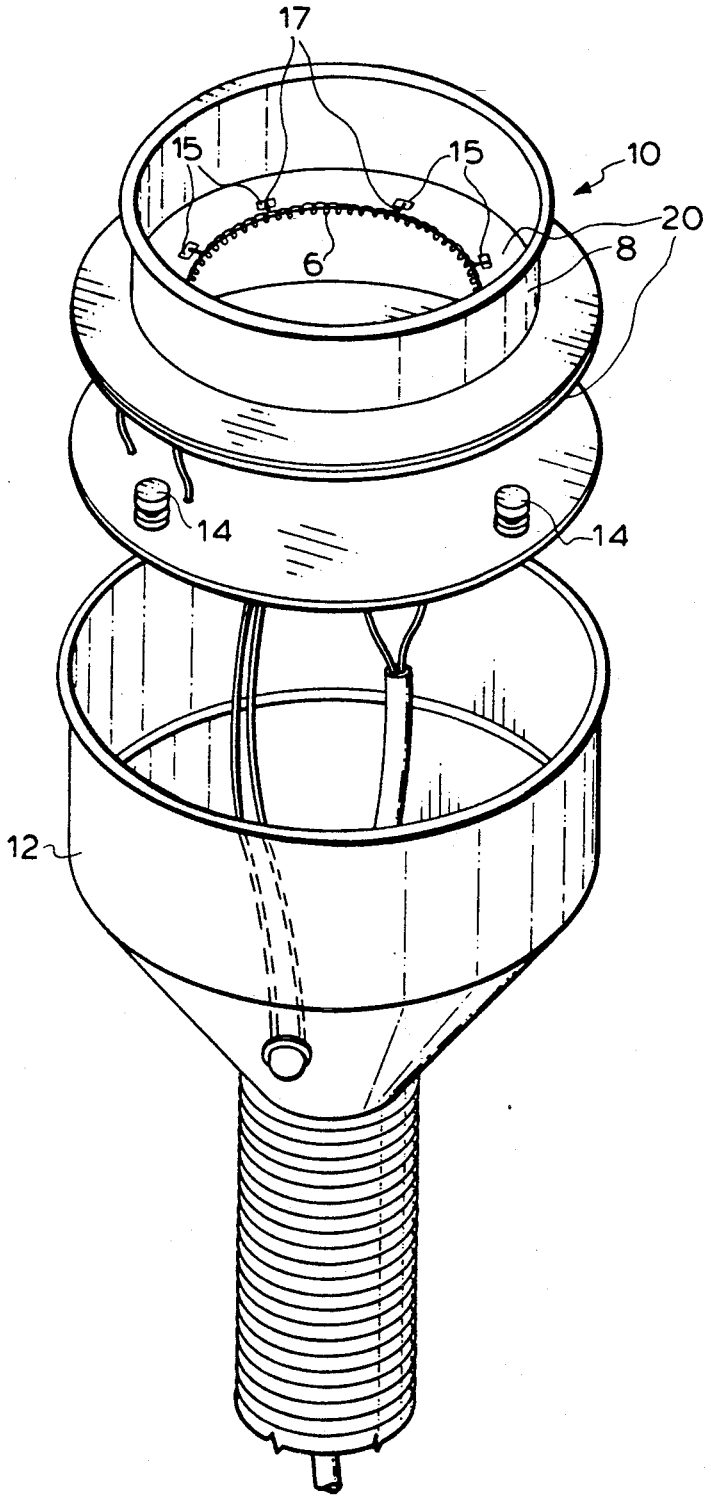
FIG. 4 is a partial exploded perspective view of the fire detector testing device.

As shown in FIG. 4, the resistance coil heater can be assembled on the mounting board 20 with the outer periphery of the mounting board 20 sized for receipt within the outer housing 12. The audible alarm 22, the timing circuit components 24 and the switches 14 are all secured on a circuit board 25 which, again, has an outer periphery sized for receipt within the outer housing 12. This circuit board 25 bottoms out on shoulders 29 of the housing and position the switches beneath mounting board 20 which is in contact with outwardly depending flanges 23 of the locating collar 8. These flanges, again, serve to locate the collar 8 within the housing 12. Thus, the various components may merely be inserted within the housing 12, simplifying assembly, if desired.

The resistance coil heater has a resistance of about 25 ohms and when activated does not glow red. This implies a somewhat low operating temperature, reducing the danger of exceeding the fixed point activation mechanism and allowing the coil to cool faster.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A testing device for fire detectors having a rate of temperature rise sensor comprising:

a resistance heating element disposed outwardly of a clear center area, and stop means located to one side of and about said resistance heating element for locating of a fire detector within said clear area, with said heating element about the periphery of the fire detector, said heating element being of low thermal mass, said testing device including an electrical switch arrangement for activating said resistance heating element.

2. A testing device for fire detectors as claimed in claim 1, wherein said stop means is a collar about said heating element, said collar including at the edge thereof a contact material to reduce scratching of a fire detector when brought in contact therewith.

3. A testing device for fire detectors as claimed in claim 2, wherein said heating element is secured on a board and wherein said board and said collar are axially movable within a housing between an operating position and an inoperative position, said electrical switch arrangement including on electrical switch parallel with said heating element and operable when said collar and board are in said operating position.

4. A testing device for fire detectors as claimed in claim 3, wherein said electrical switch arrangement is fixed in said housing and is operable by movement of said board and said collar to said operating position.

5. A testing device for fire detectors as claimed in claim 4, wherein said electrical switch arrangement is spring biased and urges said board and said collar to said inoperative condition.

6. A testing device for fire detectors as claimed in claim 5, wherein said board has a generally circular aperture centrally disposed with said resistance, heating element extending therein.

7. A testing device for fire detectors as claimed in claim 6, wherein said board includes a plurality of solder points thereabout with said heating element secured thereto.

8. A testing device for fire detectors as claimed in claim 7, wherein said heating element is secured by a plurality of wire loops each soldered to a solder point and looped about said heating element.

9. A testing device for fire detectors as claimed in claim 1 including timing means and an alarm, said alarm being actuated after a predetermined time period determined by said timing means which is initiated upon actuation of said heating element.

10. A testing device for fire detectors as claimed in claim 9 including visual indication means in series with said element to indicate actuation of said element.

11. A testing device for fire detectors as claimed in claim 10, wherein said visual indication means is a light emitting diode.

12. A testing device for fire detectors as claimed in claim 9, including a housing supporting said heating element therewithin and wherein said housing includes a spring extension connection joining a handle to said housing, said spring extension accommodating changing orientations of said housing relative to said handle due to the flexibility of said spring extension.

13. In combination, a fire detector device having a rate of temperature rise sensor and a separate portable testing device for selective association with said fire detector device and heating of said fire detector when selectively associated therewith at a rate sufficient to actuate said rate of temperature rise sensor, said detector having a variable volume pressure chamber partially defined by a housing of said detector and said testing device including a resistance heating element configured to be in close proximity about the sides of said housing and radiate energy thereto with the surrounding air acting at least initially to remove heat from said housing, said testing device primarily heating said housing and said pressure chamber by radiating energy to the sides of said housing and pressure chamber.

14. In combination as claimed in claim 13, wherein said fire detector also includes a fixed temperature sensor centrally disposed and isolated from said housing, said heating element being spaced from said fixed temperature sensor such that energy radiated to said housing by said resistance heating element is several times greater than energy radiated to said fixed temperature sensor by said resistance heating element.

15. In combination as claimed in claim 14, wherein said element is positioned in said testing device to be in close proximity to said housing and separated from said fixed temperature sensor at least twice the separation distance of said element and said housing.

16. In combination, a fire detector and a testing unit for selective actuation of said detector, said detector having a fixed temperature actuation point mechanism and a rate of temperature rise actuation mechanism, said fixed temperature actuation mechanism having a collection fin centrally disposed and thermally isolated from said rate of temperature rise actuation mechanism, said testing unit including a heating element shaped when appropriately located relative to said detector to be exterior to and spaced from said collection fin and in close proximity to said rate of temperature rise actuation mechanism such that said heating element is several times closer to a heat collecting surface of said rate of temperature rise actuation mechanism than said collection fin, said testing unit further including means for appropriately locating said heating element relative to said fire detector such that said heating element when activated by an electrical current radiates energy to said collecting surface at a rate greater than the rate of radiating energy between said heating element and said collection fin causing a sensed rate of temperature to actuate said detector without activating said fixed temperature actuation mechanism.

17. In combination as claimed in claim 16, wherein said testing unit includes a collar having a predetermined structural relationship with said heating element, said collar guiding said heating element into appropriate registration with said fire detector thereby locating said heating element relative to said collection surface and said collection fin.

18. In combination as claimed in claim 17, wherein said collar cooperates with said detector to form a closed air volume, said closed air volume serving to dissipate energy and maintain the temperature of said collection fin below said activation temperature.

19. In combination as claimed in claim 18, wherein said testing unit is powered by a portable 24 volt power supply.

20. In combination as claimed in claim 18 including timing means associated with said heating element which actuates a warning after a predetermined period of continuous operation of said heating element, said period of time representing a particular operation period of said testing device.

21. In combination as claimed in claim 20 including a light source which is actuated whenever said heating element is actuated.

* * * * *